United States Patent [19]

Dunn

[11] Patent Number: 4,760,883

[45] Date of Patent: Aug. 2, 1988

[54] WELLBORE PERFORATING

[75] Inventor: Michael D. Dunn, Houston, Tex.

[73] Assignee: Atlantic Richfield Company, Los Angeles, Calif.

[21] Appl. No.: 637,190

[22] Filed: Aug. 2, 1984

[51] Int. Cl.[4] ..... E21B 37/00; E21B 43/116

[52] U.S. Cl. ..... 166/297; 166/312

[58] Field of Search ..... 175/4.52; 166/297, 55.1, 166/312

[56] References Cited

U.S. PATENT DOCUMENTS

| | | | |
|---|---|---|---|
| 2,913,053 | 11/1959 | Westbrook | 166/312 |
| 3,011,551 | 12/1961 | Young et al. | 175/4.52 |
| 3,302,715 | 2/1967 | Smith et al. | 166/312 |
| 3,820,604 | 6/1974 | Karnes | 166/297 |
| 3,856,094 | 12/1974 | Davis | 175/4.52 |
| 4,372,384 | 2/1983 | Kinney | 166/297 |

*Primary Examiner*—Jerome Massie
*Assistant Examiner*—David J. Bagnell
*Attorney, Agent, or Firm*—Roderick W. MacDonald

[57] ABSTRACT

A method and apparatus for perforating at least one mineral-producing zone in a wellbore wherein a packer and perforating gun assembly is employed which will allow the removal of wellbore liquid initially present in the wellbore adjacent said zone to be removed after the packer and perforating gun assembly has been fixed in the wellbore so that subsequent detonation of said perforating gun is carried out in a liquid which is nondeleterious to said zone.

4 Claims, 2 Drawing Sheets

WELLBORE PERFORATING

BACKGROUND OF THE INVENTION

Heretofore, when a wellbore has been drilled in the earth and passes through a mineral-producing zone such as a reservoir which produces crude oil and/or natural gas, the mineral produced by this zone has often been produced from the wellbore to the earth's surface by setting a packer means in the wellbore above the producing zone. The packer has production tubing passing therethrough and extending from the vicinity of the producing zone to the earth's surface so that oil and/or gas flowing from the producing zone into the wellbore passes into the interior of the production tubing since the packer seals off the annulus between the outside of the production tubing and the inside of the wellbore. The produced oil and/or gas then passes through the production tubing to the earth's surface for recovery and other disposition as desired.

Sometimes, in order to increase a flow of oil and/or gas from the reservoir or producing zone into the wellbore, and thereby increase the productivity of the well itself, a process is carried out which is well known as perforating. When perforating a well a gun containing explosive charges is lowered into the wellbore adjacent the producing zone and then detonated to direct the explosion outwardly into the zone to create large channels for the oil and gas to flow into more readily. These channels also conduct the oil and gas therein quite efficiently to the wellbore itself.

If the perforating gun is lowered on a wire line through the interior of the production tubing after the packer and tubing have been set in the wellbore, the perforating gun is limited in size and power because of the inside diameter limitation of the production tubing itself. Therefore, in this "through-tubing" perforating procedure, the perforating gun or guns, because of their limited size, only shoot in one direction into the zone rather than in a plurality of directions around the 360° circumference of the perforating gun.

One advantage of this procedure relates to the liquid initially present in the wellbore before the perforating operation is carried out. Sometimes this wellbore liquid is deleterious to the producing zone because it causes clays in the zone to swell or otherwise become blocked so that the productivity of oil and/or gas from the zone is actually decreased after the perforating operation. Therefore, it is desirable not to perforate through this liquid since the perforating operation would force this liquid into the zone and harm the zone itself. In the through-tubing procedure, the wellbore liquid below the packer can be removed and replaced with a nondeleterious liquid while still keeping heavier weighted liquid above the packer which could be deleterious to the zone but which is beneficial above the packer because it lessens the chance of a well blow-out should the packer itself fail to seal adequately between the outside of the production tubing and the inside of the wellbore. Thus, through-tubing perforating is a safe procedure from a well control point of view but leaves something to be desired when a large amount of perforating in various directions around the wellbore is desired.

Another perforating procedure often used is "tubing conveyed" perforating wherein the perforating gun or guns are first fixed to and below the packer before it is placed in the wellbore so that the perforating guns are not limited by the internal diameter of the production tubing but rather only by the internal diameter of the much larger wellbore itself. This way, much larger perforating guns can be employed and a plurality of charges spaced around the periphery of the perforating gun or guns used so that perforations can be created around the 360° circumference of the wellbore as desired. For example, the charges can be spaced 90° apart, 120° apart, or any other spaced angle around the periphery of the gun so that channels are created at a plurality of places around the interior of the wellbore. This is a substantial advantage for this procedure. However, if it is desirable in this procedure to remove the initial wellbore liquid because it is deleterious to the producing zone or zones to be perforated, then this liquid must be removed from the entire wellbore before the packer-perforating gun assembly is lowered into the wellbore and set into place. Thus, the same type of liquid is present above and below the packer and thus runs a greater risk of a well kick or blow-out should, for example, the packer leak and high pressure natural gas escape around the packer into an upper section of the wellbore. This is so because the upper section of the wellbore will not contain a weighted liquid which could prevent the kick or blow-out but rather only contains the same liquid desired below the packer between the perforating gun and zone or zones to be perforated. Therefore, the tubing conveyed perforating procedure leaves something to be desired as well.

However, the tubing conveyed procedure has the distinct advantage that the larger perforating guns can penetrate further out into the formation and leave larger channels therein. This is known as increased perforation efficiency which, in turn, leads to increased production of desirable fluids from the perforated formation.

BRIEF SUMMARY OF THE INVENTION

In accordance with this invention, a method and apparatus are employed which allows the use of large perforating guns, those used in the above-described tubing conveyed perforating procedure, but which also allows the use of a nondeleterious light liquid below the packer while retaining heavier blow-out preventing liquid above the packer as practiced in the above-described through-tubing perforating procedure. By this invention, much greater perforating capability is achieved while still retaining the substantial safety feature of employing heavy liquid above the packer for blow-out containment purposes.

This substantial combination of advantages is achieved in accordance with this invention by employing a packer which carries a specially designed sub. The sub carries the perforating gun or guns and also has means which will be described in greater detail hereinafter, for allowing the removal of wellbore liquid from below the packer and the replacement of that liquid with nondeleterious liquid through which perforating is desired. This liquid removal and replacement is carried out after the assembly has been placed and set in the wellbore with heavy, blow-out preventing liquid already present above the packer.

Accordingly, this invention achieves much greater flexibility and capability for more extensive perforating of a producing zone or zones without sacrifice of any safety features.

Accordingly, it is an object of this invention to provide a new and improved method and apparatus for perforating one or more producing zones in a wellbore.

It is another object of this invention to provide a new and improved method and apparatus for conducting in a wellbore a perforating procedure in desirable light liquid while keeping a substantial part of the upper portion of the wellbore full of a weighted liquid for blow-out protection.

It is another object of this invention to provide a new and improved method and apparatus for achieving maximum perforating capability while retaining maximum blow-out protection.

Other aspects, objects and advantages of this invention will be apparent to those skilled in the art from this disclosure and the appended claims.

DETAILED DESCRIPTION OF THE INVENTION

Figure 1:
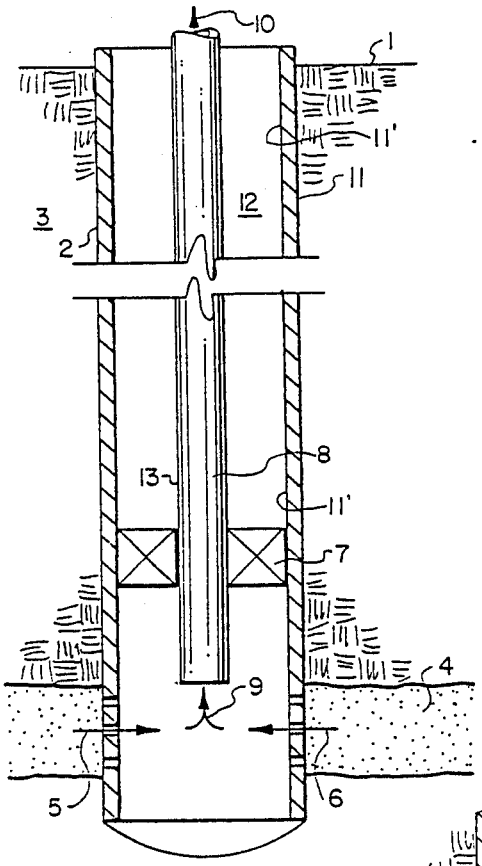
FIG. 1 (PRIOR ART)
FIG. 1 shows a conventional well completion for a single producing zone at the bottom of a wellbore using a packer and production tubing.

FIG. 1 shows the earth's surface 1 wherein a wellbore 2 has been drilled downwardly into the earth until it penetrated mineral-producing zone 4. Although this invention will be disclosed hereinafter, for sake of clarity and simplicity, with respect to a single producing zone 4 and a single perforating gun, it is to be understood that this invention covers multiple completion wells in which two or more producing zones are present and/or two or more perforating guns are employed. Similarly, a plurality of production tubing lines can be employed for multiple completion wells as is known and which would be obvious to one skilled in the art once apprised of the advantages of this invention. The invention also applies to cased or uncased wellbores. This invention is applicable to any mineral, sulfur, uranium, etc., produced from a subterranean geologic reservoir but again for sake of simplicity and clarity, will hereinafter be described only in relation to crude oil and natural gas.

In FIG. 1, oil and/or gas would flow from zone 4 through perforations in casing 11 into the interior of wellbore 2 as shown by arrows 5 and 6. Conventional production completion for this well would employ a conventional packer means 7 and production tubing 8 so that oil and gas flowing into the bottom of wellbore 2 would pass into the interior of production tubing 8 as indicated by arrow 9 and flow upwardly therein to the earth's surface, as indicated by arrow 10, for recovery there and further processing and disposition as desired.

Packer 7 is fixed to the inner wall 11' of casing 11 and to the outer wall 13 of production tubing 8 so that the lower portion of annulus 12 in wellbore 2, i.e., the portion below packer 7, is sealed in a liquid-tight manner from the upper portion of annulus 12 above packer 7. Annulus 12 between inner wall 11' and outer wall 13 above packer 7 can be filled with a heavy liquid well known in the art so that should packer 7 leak some gas therearound into the upper portion of annulus 12, a blow-out will not occur because of the presence of that weighted liquid. If weighted liquid were not present, and a light salt water solution was present instead, gas leaking around packer 7 into the upper portion of wellbore 2 could rise rapidly and in large volume to the earth's surface through annulus 12 pushing whatever liquid was present in annulus 12 ahead of it and causing a well kick. Thus, it is quite desirable to leave weighted liquid in annulus 12 above packer 7 regardless of the type of liquid present in wellbore 2 below packer 7.

Figure 2:
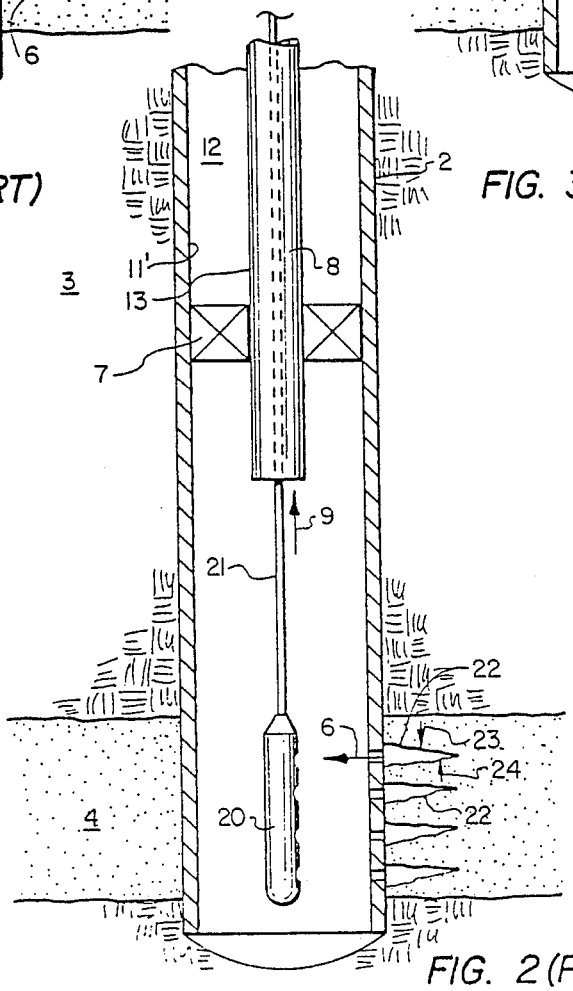
FIG. 2 (PRIOR ART)
FIG. 2 shows the system of FIG. 1 wherein a conventional through-tubing perforating procedure is carried out.

FIG. 2 shows the prior art practice of through-tubing perforating using the completion apparatus shown in FIG. 1. In this procedure, a perforating gun 20 is lowered by means of wire line 21 through the interior of production tubing 8 until it is adjacent to zone 4. Thereafter, the gun is detonated which explodes holes through any wellbore casing and into zone 4 to form channels 22 therein. This way oil and gas in the interior of zone 4 can flow into these channels as shown by arrows 23 and 24. Open channels 22 readily conduct oil and gas into wellbore 2 as shown by arrow 6 for more rapid production of oil and gas from zone 4.

Conventional production tubing can, for example, be $2\frac{3}{8}$ inch outside diameter (O.D.) or $2\frac{7}{8}$ inch O.D. In the through-tubing procedure, a one inch O.D. coiled injection tubing (not shown) can be run down the interior of production tubing 8 for the displacement of wellbore liquid initially present in the wellbore when packer 7 was set, if this wellbore liquid is undesirable from a perforating point of view. In other words, if the wellbore liquid which is present between perforating gun 20 and zone 4 and which would be forced into zone 4 by way of channels 22 when the perforating gun was detonated, is harmful to the producing qualities of zone 4, then it would be counter-productive to perforate through this liquid. By use of the injection tubing, the wellbore liquid can be displaced in a known manner from the wellbore below packer 7 with a nondeleterious liquid injected into the wellbore below packer 7. Thus, when subsequent detonation of perforating gun 20 is carried out, the explosive charges pass through nondeleterious liquid and zone 4 is not damaged when this liquid passes into channels 22.

By this procedure, perforating can be carried out through a nondeleterious liquid even though, above packer 7 in annulus 12 there is present a weighted material which would be deleterious to zone 4 if it were present below packer 7. However, because gun 20 has to be lowered through the interior of production tubing 8, the size of gun 20 is substantially limited and this limitation allows for shooting in only one direction in the wellbore. Note that in FIG. 2, channels 22 are only formed on the right side of the drawing and no channels are formed on the left side. Similarly, no channels are formed to the front or to the rear of gun 20. It is much more desirable to phase the charges around the periphery of gun 20 so that channels 22 are formed in a plurality of directions around the 360° circumference of gun 20. This way a substantially larger number of perforations 22 are formed in zone 4 in all directions around wellbore 2. However, this is not possible with through-tubing perforating.

Figure 3:
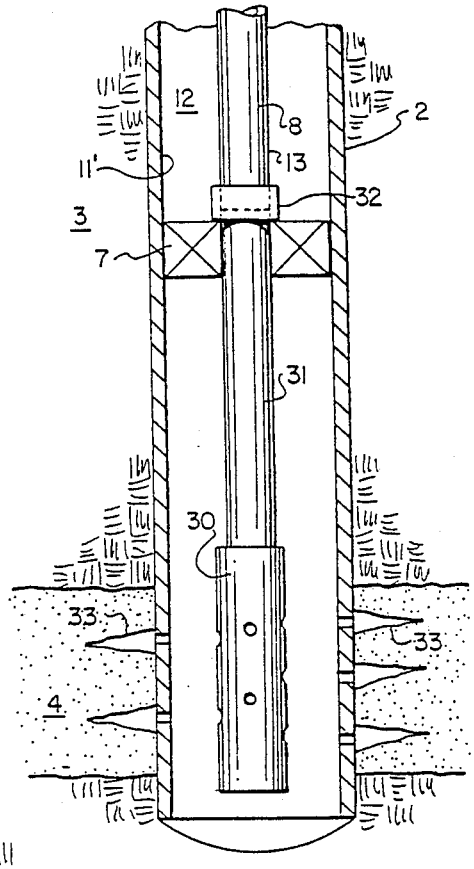
FIG. 3 (PRIOR ART)
FIG. 3 shows the wellbore of FIG. 1 wherein a conventional tubing conveyed perforating procedure is carried out.

FIG. 3 shows the prior art tubing conveyed procedure wherein a large perforating gun 30 is, at the earth's surface, fixed to packer 7 by way of conduit means 31. Production tubing 8 latches to conduit means 31 by way of conventional latch means 32 and this whole assembly is then lowered into the wellbore at one time in a conventional manner. By this procedure, a much larger perforating gun 30 can be employed than could be passed through the interior of production tubing 8 so that perforations phased around the 360° circumference of gun 30 can be achieved and perforation channels 33 formed in multiple directions around gun 30 in zone 4. Further, an improved perforating efficiency can be achieved. This phased perforating and increased perforating efficiency has a substantial positive impact on the production of oil and gas into wellbore 2 from all directions around the circumference of wellbore 2 in zone 4.

A disadvantage for this tubing conveyed procedure is that if there is deleterious wellbore liquid initially present in the wellbore, this liquid must be removed and replaced with the lighter nondeleterious liquid through which perforating is desired, but since this wellbore liquid is removed before the packer 7-perforating gun 30 assembly is lowered into the wellbore, the same lightweight liquid is present both below and above packer 7 in annulus 12. Thus, blow-out protection is reduced.

Normally, blow-out preventing liquids have a substantial amount of one or more weighting materials, such as barite, added thereto and it is not desirable to force these sorts of materials into the interior of zone 4. It is more desirable to perforate through a liquid such as weater which can contain one or more dissolved salts, such as alkali metal halides therein. The lighter liquid produces less resistance to the perforating charge as it passes therethrough and does no damage to zone 4, e.g., by swelling clays or plugging pores therein through which the oil and gas has to pass to reach channel 33. So, the heavy blow-out preventing liquid is not desirable below packer 7 and the light perforating liquid is not desirable above packer 7, but this is not achievable by the tubing conveyed procedure of FIG. 3.

Figure 4:
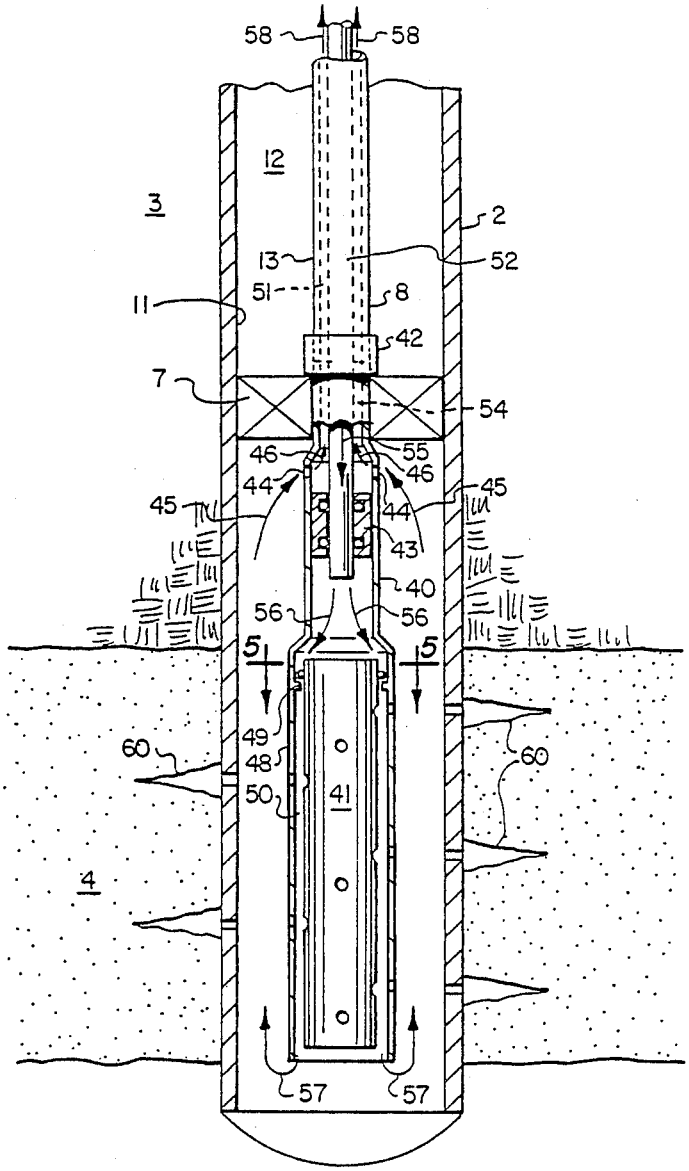
FIG. 4 shows the wellbore of FIG. 1 wherein one procedure within this invention is employed together with one embodiment of the apparatus of this invention.

In accordance with this invention, the advantages of both prior art procedures described hereinabove are achieved while eliminating the above-described disadvantages. This is accomplished by this invention, one embodiment of which, is shown in FIG. 4.

In this embodiment, conventional production tubing 8 and packer 7 are employed. However, a specially designed sub 40 is used between perforated gun 41 and packer 7, sub 40 being fixed to packer 7 and either sub 40 or packer 7 having conventional latching means 42 for fixing the sub 40-packer 7 assembly to production tubing 8. Sub 40 carries internally thereof conventional seal means 43 and has between packer 7 and seal means 43 a plurality of ports 44 so that liquid can flow from the exterior of sub 40 to the interior of sub 40 as shown by arrows 45 and 46. The lower end of sub 40 carries an elongate hollow housing 48 which is essentially in longitudinal axial alignment with sub 40 and which carries internally thereof conventional latch means 49 for supporting perforating gun 41 inside housing 48. Housing 48 is sized so that the interior wall of housing 48 is spaced from the exterior wall of gun 41 to provide an annulus 50 therebetween which can serve as a liquid flow course which will be described hereinafter.

Production tubing 8 in this invention can still be conventional $2\frac{3}{8}$ inch or $2\frac{3}{4}$ inch O.D. tubing so that when a conventional one inch O.D. injection tubing is run down the interior of production tubing 8, an annulus 51 is present between the exterior wall of injection tubing 52 and the interior wall of production tubing 8 to provide another liquid flow course. When injection tubing 52 is passed from the earth's surface down through the interior of production tubing 8 and into sub 40, it passes into sealing engagement with seal means 43 thereby providing a liquid-tight seal between the lower portion of sub 40 below annulus 54 and above seal means 43, annulus 54 being defined by the outer wall of injection tubing 52 and the inner wall of sub 40. It can be seen that liquid course annulus 54 and liquid course annulus 51 are in alignment and in open communication with one another.

When liquid at the earth's surface is passed into the interior of injection tubing 52, it flows downwardly therein as shown by arrow 55, passes through sub 40, and is released from the interior of injection tubing 52 below seal means 43 to flow as shown by arrows 56, into annulus 50. The liquid then flows downwardly past gun 41 and outwardly from the lower end of housing 40 into wellbore 2 as shown by arrows 57. From the bottom of wellbore 2, the displacement liquid flows upwardly outside of housing 48 toward ports 44 as shown by arrows 45 forcing ahead of it the undesired wellbore liquid which was initially present in the wellbore when the assembly was first lowered thereinto and packer 7 set in the position shown in FIG. 4. The displacement liquid, with the wellbore liquid ahead of it, passes through ports 44 into annulus 54 and then into annulus 51 as shown by arrows 58 for passage to the earth's surface for recovery and removal.

A large perforating gun 41 can be employed which is not limited by the internal diameter of production tubing 8 and at the same time undesired wellbore liquid below packer 7 can be removed and replaced by desirable, nondeleterious, lightweight liquid while leaving weighted blow-out preventing liquid above packer 7 in annulus 12. The advantages of both prior art procedures as described in relation to FIGS. 2 and 3 above are obtained while eliminating the disadvantages of those procedures. For example, phased perforating with large guns and enhanced perforating efficiency is achieved so that deeper channels 60 are formed around the entire circumference of wellbore 2 in zone 4 while, at the same time the perforation procedure is carried out through nondeleterious liquid below packer 7 with blow-out preventing weighted liquid above packer 7.

Figure 5:
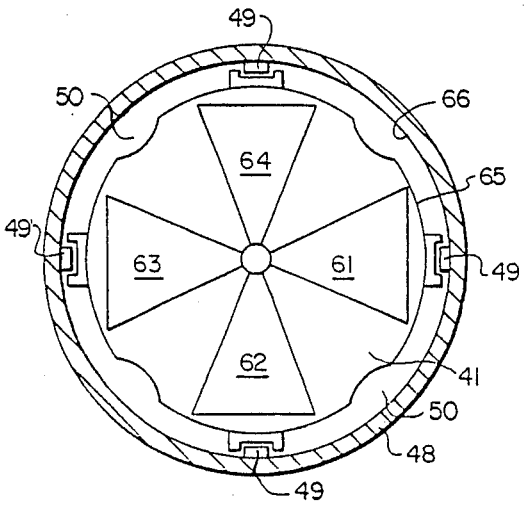
FIG. 5 shows a cross section of one embodiment of the apparatus of this invention.

FIG. 5 shows a cross section through gun 41 and housing 48 of FIG. 4 above latching means 49. Latching means 49 can be any conventional oil tool slips or latching dogs which serve to support gun 41 inside housing 48. Latching means 49 is set high in housing 48 so that the perforating projectiles pass out of gun 41 and through housing 48 below latch means 49. Any conventional perforating gun 41 can be employed such as the scallop gun shown in FIG. 5 which employs 90° phasing for charges 61 through 64, the projectiles being contained within those charges. Annulus 50 between the outer wall 65 of gun 41 and the inner wall 66 of housing 48 provides the liquid flow course for displacement liquid which emerges from injection tubing 52 into sub 40 and flows in the manner shown by arrows 56 and 57.

Figure 6:
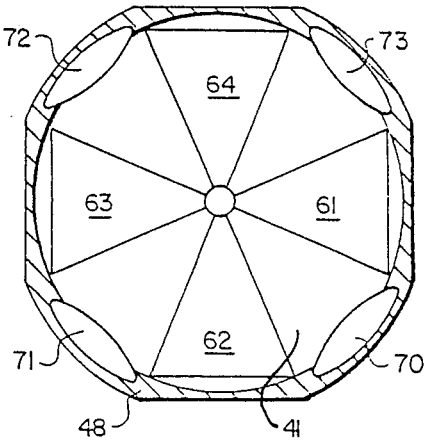
FIG. 6 shows the cross section of yet another embodiment of apparatus within this invention.

Various modifications can be made in the apparatus of this invention as just described as would be obvious to one skilled in the art and still be within the scope of this invention. For example, instead of having a continuous annulus 50 between gun 41 and housing 48, as shown in FIG. 6, latch means 49 could be eliminated and gun 41 made integral with housing 48 such as by welding. In this embodiment isolated liquid flow courses 70 through 73 are cut into the outer wall of gun 41 and the inner wall of housing 48 between adjacent charges 61 through 64.

EXAMPLE

The apparatus shown and described above in relation to FIGS. 4 and 5 is employed in a single zone completion using a wellbore 2 lined with steel production casing on the interior wall of the wellbore. Wellbore 2 has about a four inch I.D., packer 7 being adapted to seal against the interior wall of the five inch O.D. production casing. Production tubing 8, $2\frac{7}{8}$ inch O.D., is employed with one inch O.D. injection tubing 52. Gun 41 has a $3\frac{3}{8}$ inch O.D. while housing 48 has a $2\frac{1}{8}$ inch O.D. and $3\frac{5}{8}$ inch I.D. Ports 44 are about $\frac{3}{4}$ inches in diameter, 4 in number, and are spaced uniformly around the circumference of sub 40. Water having at least one alkali metal halide, preferably at least one of sodium chloride and potassium chloride, dissolved therein is employed as the displacing liquid for removing the liquid initially left in wellbore 2. Water heavily weighted with barite suspended therein is left in annulus 12 above packer 7. Displacement liquid is passed downwardly through injection tubing 52 into wellbore 2 below housing 48 until essentially all of the initial wellbore liquid present below packer 7 has been flushed from the wellbore through annulus 51 to the earth's surface thereby leaving essentially only displacement liquid in wellbore 2 below packer 7. Detonation of perforating gun 41 is then carried out in a conventional manner such as by removing tubing 52 and dropping a metal bar down tubing 8 to impact and detonate gun 41. Gun 41 can vary from $3\frac{3}{8}$ inch O.D. to $5\frac{1}{2}$ inch O.D. in the case of a six inch wellbore. The charges that can be carried by these larger guns can be from two to three times larger than through-tubing gun 20 of FIG. 2.

Reasonable variations and modifications are possible within the scope of this disclosure without departing from the spirit and scope of this invention.

I claim:

1. In a method for perforating at least one mineral producing zone in a wellbore in the earth wherein at least one perforating gun is set in said wellbore adjacent said at least one zone and then detonated to perforate said at least one zone, said wellbore initially containing a wellbore liquid therein adjacent said at least one zone, the improvement comprising providing an assembly comprising a packer having a hollow sub fixed thereto which extends below said packer, at least one of said packer and sub having latch means for fixing said sub to production tubing which extends from said sub to the earth's surface, said sub having ports therein below said packer for admitting liquid from the exterior of said sub to the interior of said sub, said sub carrying below said ports seal means for sealing around injection tubing which passes through the interior of said production tubing and is inserted into hollow interior of said sub, said sub carrying below said seal means a hollow housing in essentially longitudinally axial alignment with said sub, said housing being adapted to receive and support internally thereof at least one perforating gun, said housing being sized so that space is provided in at least one location to allow liquid flow from the interior of said sub below said seal means through said space and out from a lower portion of said housing into said wellbore, lowering said assembly into said wellbore on said production tubing, actuating said packer to fix said assembly in said wellbore so that said at least one perforating gun in said assembly is adjacent said at least one zone to be perforated and so that the portion of the wellbore below said packer is separated in a liquid tight manner from the portion of the wellbore above said packer, lowering injection tubing through the interior of said production tubing and into sealing engagement with said seal means carried by said sub, said injection tubing being sufficiently smaller than said production tubing to provide an annulus for liquid flow outside said injection tubing and inside said production tubing, said annulus being in fluid communication with the ports in said sub but not below said seal means in said sub, circulating displacement liquid from the earth's surface down the interior of said injection tubing into the interior of said sub below said seal means in said sub, passing said displacement liquid through said space in said housing and out into said wellbore below said housing and packer, passing said displacement liquid in said wellbore upwardly in said wellbore outside said housing up to and through said ports in said sub and into said annulus between said production tubing and injection tubing, recovering said displacement liquid from said annulus between said production tubing and injection tubing at the earth's surface, said displacement liquid being essentially nondeleterious to said at least one zone to be perforated so that said wellbore liquid which is initially present in said wellbore below said packer and adjacent said at least one zone is essentially replaced by said nondeleterious displacement liquid before said zone is perforated, and thereafter detonating said at least one perforating gun to perforate said at least one zone.

2. The method of claim 1 wherein said nondeleterious liquid is a water based liquid.

3. The method of claim 2 wherein said water based liquid has dissolved therein substantial amounts of at least one alkali metal halide.

4. The method of claim 3 wherein said alkali metal halide is at least one of potassium chloride and sodium chloride.

* * * * *